US010697248B2

(12) United States Patent
Russell et al.

(10) Patent No.: US 10,697,248 B2
(45) Date of Patent: Jun. 30, 2020

(54) EARTH-BORING TOOLS AND RELATED METHODS

(71) Applicant: Baker Hughes, a GE company, LLC, Houston, TX (US)

(72) Inventors: Steven Craig Russell, Sugar Land, TX (US); Kenneth R. Evans, Spring, TX (US); Oliver Matthews, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 253 days.

(21) Appl. No.: 15/725,097

(22) Filed: Oct. 4, 2017

(65) Prior Publication Data

US 2019/0100967 A1 Apr. 4, 2019

(51) Int. Cl.

| | |
|---|---|
| ***E21B 10/43*** | (2006.01) |
| ***E21B 10/55*** | (2006.01) |
| ***E21B 10/567*** | (2006.01) |
| ***E21B 10/56*** | (2006.01) |

(52) U.S. Cl.

CPC ..... *E21B 10/43* (2013.01); *E21B 10/55* (2013.01); *E21B 10/56* (2013.01); *E21B 10/5673* (2013.01)

(58) Field of Classification Search

CPC ..... E21B 10/43; E21B 10/55; E21B 10/56; E21B 10/5673

See application file for complete search history.

(56) References Cited

U.S. PATENT DOCUMENTS

| | | | |
|---|---|---|---|
| 3,153,458 | A | 10/1964 | Short |
| 3,709,308 | A | 1/1973 | Rowley et al. |
| 4,058,177 | A | 11/1977 | Langford, Jr. et al. |
| 4,351,401 | A | 9/1982 | Fielder |
| 4,554,986 | A | 11/1985 | Jones |

(Continued)

FOREIGN PATENT DOCUMENTS

| | | | |
|---|---|---|---|
| EP | 1116858 | B1 | 7/2001 |
| EP | 1190791 | A2 | 3/2002 |
| WO | 2016/153499 | A1 | 9/2016 |

OTHER PUBLICATIONS

Written Opinion of the International Searching Authority for International Application No. PCT/US2018/054002, dated Jan. 30, 2019, 10 pages.

(Continued)

*Primary Examiner* — Daniel P Stephenson
(74) *Attorney, Agent, or Firm* — TraskBritt

(57) ABSTRACT

An earth-boring tool comprising a body having first cutting elements mounted to an axially leading face, the first cutting elements each having a cutting face exposed to a height above the face of the body, the cutting faces of the first cutting elements back raked and facing a direction of intended rotation of the earth-boring tool. The earth-bring tool further comprises second cutting elements mounted to the axially leading face of the body adjacent first cutting elements in a cone region of the bit face, the second cutting elements each having a cutting face exposed to a height above the face of the body and configured for a shear-type cutting action, the cutting faces of the second cutting elements back raked to about a same or greater extent than the first cutting elements and generally facing the direction of intended rotation of the earth-boring tool.

21 Claims, 5 Drawing Sheets

(56) References Cited

U.S. PATENT DOCUMENTS 4,722,405 A 2/1988 Langford, Jr.
4,889,017 A 12/1989 Fuller et al.
4,982,802 A 1/1991 Warren et al.
4,991,670 A 2/1991 Fuller et al.
5,010,789 A 4/1991 Brett et al.
5,042,596 A 8/1991 Brett et al.
5,111,892 A 5/1992 Sinor et al.
5,131,478 A 7/1992 Brett et al.
5,172,777 A 12/1992 Siracki et al.
5,199,511 A 4/1993 Tibbitts et al.
5,244,039 A 9/1993 Newton, Jr. et al.
5,303,785 A 4/1994 Duke
5,314,033 A 5/1994 Tibbitts
5,322,138 A 6/1994 Siracki
5,323,865 A 6/1994 Isbell et al.
5,402,856 A 4/1995 Warren et al.
5,443,248 A 8/1995 Hayashi et al.
5,551,768 A 9/1996 Fennel et al.
5,568,492 A 10/1996 Flint et al.
5,592,995 A 1/1997 Scott et al.
5,595,252 A 1/1997 O'Hanlon
5,697,462 A 12/1997 Grimes et al.
5,706,906 A 1/1998 Jurewicz et al.
5,746,280 A 5/1998 Scott
5,855,247 A 1/1999 Scott
6,050,354 A * 4/2000 Pessier ..... E21B 10/16 175/425
6,053,263 A 4/2000 Meiners
6,059,054 A * 5/2000 Portwood ..... E21B 10/16 175/430
6,098,730 A 8/2000 Scott
6,298,930 B1 10/2001 Sinor et al.
6,332,503 B1 12/2001 Pessier et al.
6,408,958 B1 * 6/2002 Isbell ..... E21B 10/43 175/431
6,460,631 B2 10/2002 Dykstra et al.
6,571,891 B1 6/2003 Smith et al.
6,779,613 B2 8/2004 Dykstra et al.
6,935,441 B2 8/2005 Dykstra et al.
7,621,348 B2 * 11/2009 Hoffmaster ..... E21B 10/43 175/331
7,757,791 B2 7/2010 Belnap et al.
7,762,355 B2 * 7/2010 McClain ..... E21B 10/55 175/431
7,836,979 B2 * 11/2010 Green ..... E21B 10/43 175/428
8,061,456 B2 11/2011 Patel et al.
8,087,478 B2 1/2012 Patel
8,240,403 B2 8/2012 Trinh et al.
8,448,726 B2 5/2013 Ganz
8,459,382 B2 6/2013 Aliko et al.
8,505,634 B2 8/2013 Lyons et al.
8,584,776 B2 * 11/2013 Radford ..... E21B 10/26 175/334
8,684,112 B2 4/2014 DiGiovanni et al.
8,757,297 B2 6/2014 Aliko et al.
8,794,356 B2 8/2014 Lyons et al.
8,851,207 B2 10/2014 Gavia et al.
9,051,795 B2 * 6/2015 Hall ..... E21B 10/5735
9,074,433 B2 7/2015 Hall et al.
9,074,435 B2 7/2015 Scott et al.
9,097,065 B2 8/2015 Schwefe et al.
9,133,667 B2 9/2015 Jones et al.
RE45,748 E 10/2015 Zhang et al.
9,316,058 B2 4/2016 Bilen et al.
9,366,089 B2 6/2016 Hall et al.
9,371,699 B2 6/2016 Richert et al.
9,708,856 B2 7/2017 Hall et al.
9,920,575 B2 3/2018 Meiners et al.
9,920,576 B2 * 3/2018 Spencer ..... B24D 3/008
10,066,444 B2 * 9/2018 Evans ..... E21B 7/00
10,214,968 B2 * 2/2019 Evans ..... E21B 10/62
10,392,867 B2 * 8/2019 Savage
2006/0278436 A1 12/2006 Dykstra et al.
2007/0199739 A1 * 8/2007 Schwefe ..... E21B 10/573 175/426
2008/0029312 A1 2/2008 Hall et al.
2008/0179108 A1 7/2008 McClain et al.
2009/0084607 A1 * 4/2009 Ernst ..... E21B 10/42 175/393
2009/0084608 A1 4/2009 McClain et al.
2009/0159341 A1 6/2009 Pessier et al.
2010/0276200 A1 11/2010 Schwefe et al.
2011/0155472 A1 * 6/2011 Lyons ..... E21B 10/55 175/331
2013/0081880 A1 4/2013 Schwefe et al.
2013/0228378 A1 9/2013 Chen et al.
2013/0270010 A1 10/2013 Haugvaldstad
2014/0262511 A1 * 9/2014 Bilen ..... E21B 7/064 175/40
2014/0262545 A1 9/2014 Azar et al.
2015/0129320 A1 5/2015 Overstreet et al.
2016/0053547 A1 * 2/2016 Samuel ..... E21B 10/00 175/57
2019/0100967 A1 * 4/2019 Russell ..... E21B 10/43

OTHER PUBLICATIONS

Russell et al., Earth-Boring Tools and Related Methods, U.S. Appl. No. 16/004,765, dated Jun. 11, 2018.
International Search Report for International Application No. PCT/US2018/054002, dated Jan. 30, 2019, 4 pages.

* cited by examiner

EARTH-BORING TOOLS AND RELATED METHODS

TECHNICAL FIELD

Embodiments disclosed herein relate to earth-boring tools and related methods of drilling. More particularly, embodiments disclosed herein relate to earth-boring tools incorporating structures for modifying aggressiveness of rotary earth-boring tools employing superabrasive cutting elements, and to related methods.

BACKGROUND

Rotary drag bits employing superabrasive cutting elements in the form of polycrystalline diamond compact (PDC) cutting elements have been employed for decades. PDC cutting elements are typically comprised of a disc-shaped diamond "table" formed under high-pressure and high-temperature conditions and bonded to a supporting substrate such as cemented tungsten carbide (WC), although other configurations are known. Bits carrying PDC cutting elements, which for example, may be brazed into pockets in the bit face, pockets in blades extending from the face, or mounted to studs inserted into the bit body, have proven very effective in achieving high rates of penetration (ROP) in drilling subterranean formations exhibiting low to medium compressive strengths. Improvements in the design of hydraulic flow regimes about the face of bits, cutter design, and drilling fluid formulation have reduced prior, notable tendencies of such bits to "ball" by increasing the volume of formation material which may be cut before exceeding the ability of the bit and its associated drilling fluid flow to clear the formation cuttings from the bit face.

Even in view of such improvements, however, PDC cutting elements still suffer from what might simply be termed "overloading" even at low weight-on-bit (WOB) applied to the drill string to which the bit carrying such cutting elements is mounted, especially if aggressive cutting structures are employed. The relationship of torque to WOB may be employed as an indicator of aggressiveness for cutting elements, so the higher the torque to WOB ratio, the more aggressive the bit. The problem of excessive bit aggressiveness is particularly significant in relatively low compressive strength formations where an unduly great depth of cut (DOC) may be achieved at extremely low WOB. The problem may also be aggravated by drill string oscillations, wherein the elasticity of the drill string may cause erratic application of WOB to the drill bit, with consequent overloading.

Another, separate problem involves drilling from a zone or stratum of relatively higher formation compressive strength to a "softer" zone of significantly lower compressive strength, which problem may also occur in so-called "interbedded" formations, wherein stringers of a harder rock, of relatively higher compressive strength, are intermittently dispersed in a softer rock, of relatively lower compressive strength. As a bit drills into the softer formation material without changing the applied WOB (or before the WOB can be reduced by the driller), the penetration of the PDC cutting elements, and thus the resulting torque on the bit (TOB), increase almost instantaneously and by a substantial magnitude. The abruptly higher torque, in turn, may cause damage to the cutting elements and/or the bit body itself. In directional drilling, such a change causes the tool face orientation of the directional (measuring-while-drilling (MWD), or a steering tool) assembly to fluctuate, making it more difficult for the directional driller to follow the planned directional path for the bit. Thus, it may be necessary for the directional driller to back off the bit from the bottom of the borehole to reset or reorient the tool face. In addition, a downhole motor, such as drilling fluid-driven Moineau-type motors commonly employed in directional drilling operations in combination with a steerable bottom-hole assembly, may completely stall under a sudden torque increase. That is, the bit may stop rotating, stopping the drilling operation and again necessitating backing off the bit from the borehole bottom to re-establish drilling fluid flow and motor output. Such interruptions in the drilling of a well can be time consuming and quite costly.

Numerous attempts using varying approaches have been made over the years to protect the integrity of diamond cutting elements and their mounting structures and to limit cutter penetration into a formation being drilled. For example, from a period even before the advent of commercial use of PDC cutting elements, U.S. Pat. No. 3,709,308 discloses the use of trailing, round natural diamonds on the bit body to limit the penetration of cubic diamonds employed to cut a formation. U.S. Pat. No. 4,351,401 discloses the use of surface set natural diamonds at or near the gage of the bit as penetration limiters to control the depth-of-cut of PDC cutting elements on the bit face. The following other patents disclose the use of a variety of structures immediately trailing PDC cutting elements (with respect to the intended direction of bit rotation) to protect the cutting elements or their mounting structures: U.S. Pat. Nos. 4,889,017; 4,991,670; 5,244,039 and 5,303,785. U.S. Pat. No. 5,314,033 discloses, inter alia, the use of cooperating positive and negative or neutral back rake cutting elements to limit penetration of the positive rake cutting elements into the formation. Another approach to limiting cutting element penetration is to employ structures or features on the bit body rotationally preceding (rather than trailing) PDC cutting elements, as disclosed in U.S. Pat. Nos. 3,153,458; 4,554,986; 5,199,511 and 5,595,252.

In another context, that of so-called "anti-whirl" drilling structures, it has been asserted in U.S. Pat. No. 5,402,856 that a bearing surface aligned with a resultant radial force generated by an anti-whirl underreamer should be sized so that force per area applied to the borehole sidewall will not exceed the compressive strength of the formation being underreamed. See also U.S. Pat. Nos. 4,982,802; 5,010,789; 5,042,596; 5,111,892 and 5,131,478.

While some of the foregoing patents recognize the desirability to limit cutter penetration, or DOC, or otherwise limit forces applied to a borehole surface, the disclosed approaches are somewhat generalized in nature and fail to accommodate or implement an engineered approach to achieving a target ROP in combination with more stable, predictable bit performance. Furthermore, the disclosed approaches do not provide a bit or method of drilling that is generally tolerant to being axially loaded with an amount of WOB over and in excess what would be optimum for the current rate-of-penetration for the particular formation being drilled and which would not generate high amounts of potentially bit-stopping or bit-damaging torque-on-bit should the bit nonetheless be subjected to such excessive amounts of weight-on-bit.

Various successful solutions to the problem of excessive cutting element penetration are presented in U.S. Pat. Nos. 6,298,930; 6,460,631; 6,779,613 and 6,935,441, the disclosure of each of which is incorporated by reference in its entirety herein. Specifically, U.S. Pat. No. 6,298,930 describes a rotary drag bit including exterior features to control the depth of cut by cutting elements mounted thereon, so as to control the volume of formation material cut per bit rotation as well as the torque experienced by the bit and an associated bottom-hole assembly. These features, also termed depth of cut control (DOCC) features, provide a non-cutting bearing surface or surfaces with sufficient surface area to withstand the axial or longitudinal WOB without exceeding the compressive strength of the formation being drilled and such that the depth of penetration of PDC cutting elements cutting into the formation is controlled. Because the DOCC features are subject to the applied WOB as well as to contact with the abrasive formation and abrasives-laden drilling fluids, the DOCC features may be layered onto the surface of a steel body bit as an appliqué or hard face weld having the material characteristics required for a high load and high abrasion/erosion environment, or include individual, discrete wear resistant elements or inserts set in bearing surfaces cast in the face of a matrix-type bit, as depicted in FIG. 1 of U.S. Pat. No. 6,298,930. The wear resistant inserts or elements may comprise tungsten carbide bricks or discs, diamond grit, diamond film, natural or synthetic diamond (PDC or TSP), or cubic boron nitride.

FIGS. 10A and 10B of the '930 patent, respectively, depict different DOCC feature and PDC cutter combinations. In each instance, a single PDC cutter is secured to a combined cutter carrier and DOC limiter, the carrier then being received within a cavity in the face (or on a blade) of a bit and secured therein. The DOC limiter includes a protrusion exhibiting a bearing surface.

While the DOCC features are extremely advantageous for limiting a depth of cut while managing a given, relatively stable WOB, a concern when an earth-boring tool moves rapidly between relatively harder and relatively softer formation materials of markedly difference compressive strengths under high WOB is so-called "stick-slip" of the drill string and bottom hole assembly, which occurs when the bit suddenly engages a formation too aggressively, increasing reactive torque to the extent that drill string rotation ceases until the reactive torque is great enough to rotate the drill string again, albeit in an uncontrolled manner. Thus, tool face orientation may be compromised. In addition to stick-slip, when an earth-boring tool moves rapidly between relatively softer and relatively harder formations under high WOB impact damage to PDC cutting elements and, in extreme cases, to the bit itself, may occur. Use of conventional DOCC features on a PDC cutting element-equipped drill bit may, typically, reduce bit aggressiveness on the order of about 20% to about 30% in comparison to the same bit without the DOCC features. As existing DOCC features rely solely upon the surface area of bearing elements to control exposure of PDC cutting elements and bit aggressiveness, such DOCC features may not be sufficiently responsive in terms of aggressiveness reduction to sudden changes in rock compressive strength to avoid stick-slip and impact damage.

The inventors herein have recognized the shortcomings of conventional DOCC techniques in certain subterranean drilling environments and have developed a counterintuitive, novel and unobvious approach to controlling bit aggressiveness that is substantially more responsive to changes in formation compressive strength, such as may occur with interbedded formations, than conventional DOCC techniques.

BRIEF SUMMARY

Embodiments described herein include an earth-boring tool, comprising a body, first cutting elements mounted to an axially leading face of the body, the first cutting elements each having a cutting face exposed to a height above the face of the body, the cutting faces of the cutting elements back raked and facing a direction of intended rotation of the earth-boring tool. The earth-boring tool further comprises second cutting elements mounted to the axially leading face of the body adjacent the first cutting elements in a cone region of the axially leading face adjacent a longitudinal axis of the body, the second cutting elements each having a cutting face configured for a shear-type cutting action and exposed to a height above the face of the body, the cutting faces of the second cutting elements back raked to about a same or greater extent than the first cutting elements and generally facing the direction of intended rotation of the earth-boring tool.

Embodiments described herein also include an earth-boring tool comprising a body having generally radially extending blades protruding longitudinally therefrom, first superabrasive cutting elements mounted to axially leading blade faces of the blades adjacent rotationally leading faces thereof, the first superabrasive cutting elements comprising a cutting face configured for a shear-type cutting action oriented substantially in a direction of intended bit rotation and exhibiting an aggressiveness. The earth-boring tool further comprises second superabrasive cutting elements mounted to axially leading blade faces in a cone region thereof, the second superabrasive cutting elements comprising a cutting face configured for a shear-type cutting action, oriented substantially in the direction of intended bit rotation and exhibiting a lesser aggressiveness than the aggressiveness of the first superabrasive cutting elements. The first superabrasive cutting elements and the adjacent second superabrasive cutting elements exhibit substantially the same exposure above the axially leading face of the common blade.

Embodiments described herein further include a method of drilling a subterranean formation, comprising engaging a subterranean formation to shear formation material with a first set of cutting elements of a rotary drag bit under applied WOB and TOB and substantially simultaneously engaging the subterranean formation under the applied WOB and TOB to shear formation material less efficiently with a second set of cutting elements of the rotary drag bit to reduce an aggressiveness of the rotary drag bit.

DETAILED DESCRIPTION

Figure 1A:
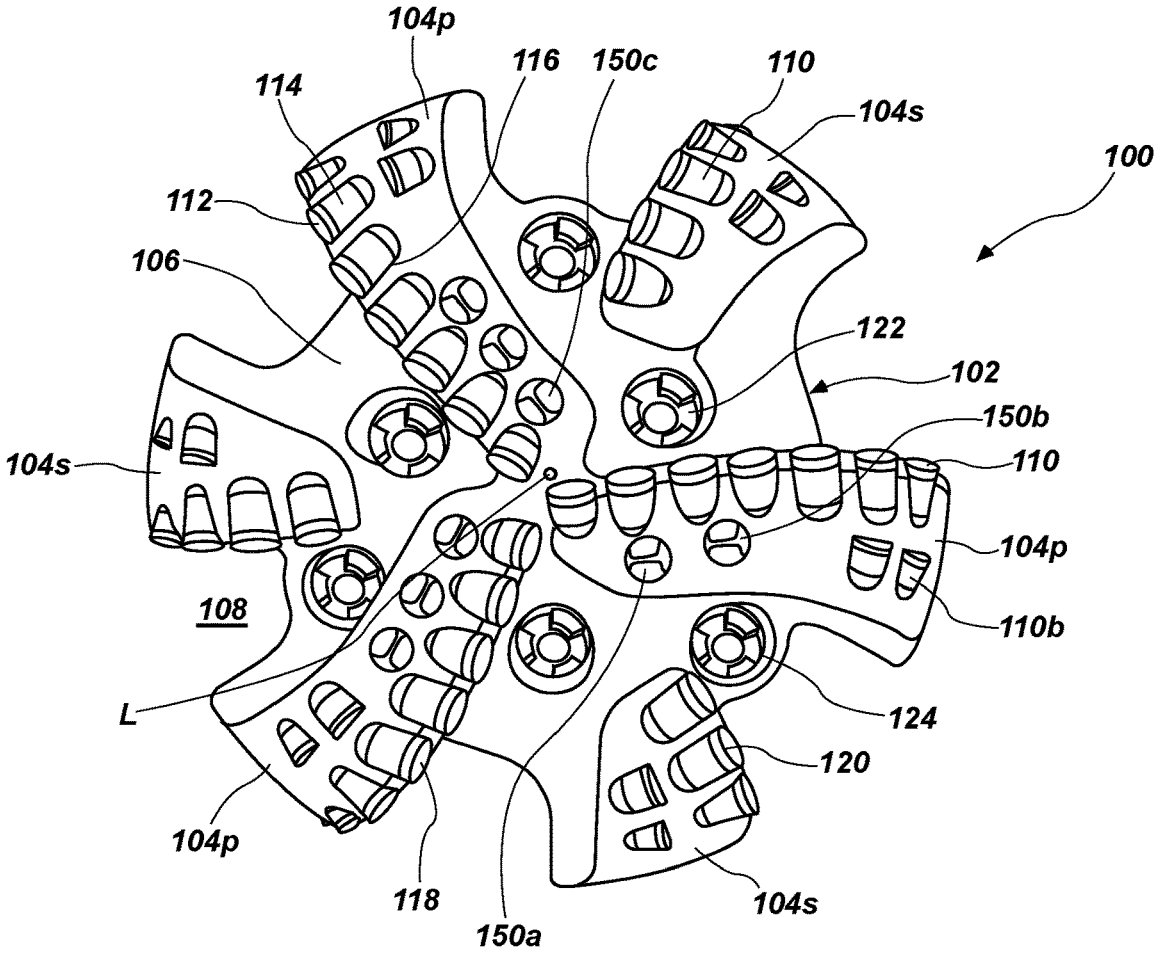
FIGS. 1A and 1B are, respectively, a bottom elevation and a partial perspective view of an earth-boring tool in the form of a drag bit, according to an embodiment of the disclosure.

In various embodiments, earth-boring tools are disclosed incorporating structures for reduction in aggressiveness of superabrasive cutting elements which are responsive to rapid and significant changes in compressive strength of rock in formations being drilled by the earth-boring tool. Unlike prior DOCC features relying upon surface area of bearing elements to limit DOC of associated PDC cutting elements, embodiments of the present disclosure employ inefficient cutting elements at substantially the same, slightly reduced exposure with respect to the superabrasive cutting elements. Sudden engagement and penetration of the inefficient cutting elements with, for example, a much softer rock substantially simultaneously with engagement and penetration by the superabrasive cutting elements results in a substantial DOC, responsive to which WOB dramatically increases, yet TOB does not dramatically increase or dramatically decrease relative to a bit without DOCC, substantially reducing the potential for stick-slip of the drill string as well as impact damage to the earth-boring tool. Similarly, when a much harder rock is encountered, the presence of the inefficient cutting elements mitigates the potential for impact damage.

The following description provides specific details, such as sizes, shapes, material compositions, and orientations in order to provide a thorough description of embodiments of the disclosure. However, a person of ordinary skill in the art would understand that the embodiments of the disclosure may be practiced without necessarily employing these specific details. Embodiments of the disclosure may be practiced in conjunction with conventional manufacturing techniques employed in the industry.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles between surfaces that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, spatially relative terms, such as "beneath," "below," "lower," "bottom," "above," "over," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "over" or "above" or "on" or "on top of" other elements or features would then be oriented "below" or "beneath" or "under" or "on bottom of" the other elements or features. Thus, the term "over" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the terms "configured" and "configuration" refer to a size, shape, material composition, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the terms "earth-boring tool" and "earth-boring drill bit" mean and include any type of bit or tool used for drilling during the formation or enlargement of a wellbore in a subterranean formation and include, for example, fixed-cutter (i.e., drag) bits, core bits, eccentric bits, bicenter bits, reamers, mills, hybrid bits (e.g., rolling components in combination with fixed cutting elements), and other drilling bits and tools employing fixed cutting elements, as known in the art.

As used herein, the term "cutting element" means and includes any element of an earth-boring tool that is configured to cut or otherwise remove formation material when the earth-boring tool is used to form or enlarge a bore in the formation. In particular, "cutting element," as that term is used herein with regards to implementation of embodiments of the present disclosure, means and includes both superabrasive cutting elements and cutting elements formed of other hard materials. Examples of the former include polycrystalline diamond compacts and cubic boron nitride compacts as well as cutting elements employing diamond and diamond-like carbon film coatings, and examples of the latter include metal carbides such as tungsten carbide (WC).

Figure 3:
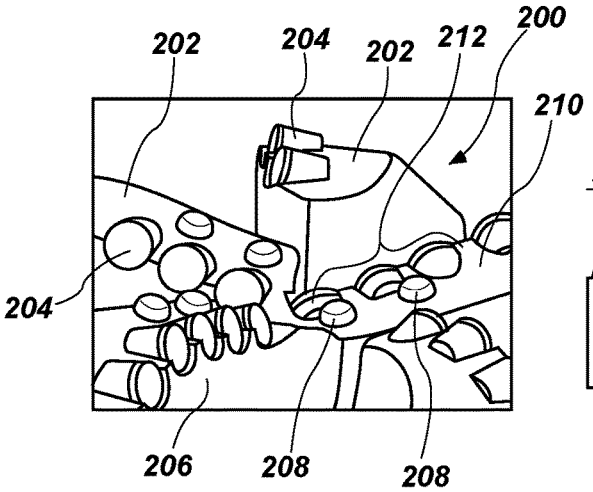
FIG. 3 (PRIOR ART)
FIG. 3 is a partial perspective view of a conventional drag bit employing ovoid bearing elements as DOCC structures.
Figure 3A:
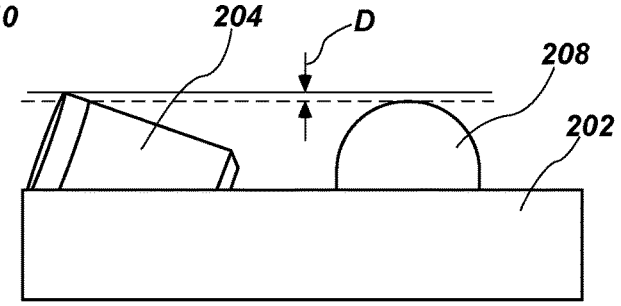
FIG. 3A (PRIOR ART)
FIG. 3A is an enlarged view of a conventional superabrasive cutting element of the drag bit of FIG. 3 rotationally trailed by an ovoid bearing element.

As used herein, the term "bearing element" means an element configured to be mounted on a body of an earth-boring tool, such as a drill bit, and to rub against a formation as the body of the earth-boring tool is rotated within a wellbore without exhibiting any substantial (i.e., measurable) shearing or other formation material removal action when in contact with formation material. Bearing elements include, for example, what are referred to in the art as conventional depth-of-cut control (DOCC) elements, or structures, for example and without limitation, ovoid-shaped bearing elements. Referring to FIGS. 3 and 3A, a conventional drag bit 200 comprising blades 202 may employ PDC cutting elements 204 adjacent rotationally leading faces 206 of the blades 202, rotationally followed by bearing elements 208 in the form of ovoids inserted in axially leading faces 210 of blades 202 in the cone region 212 of the bit face. As depicted in FIG. 3A, bearing elements 208 may be under-exposed by a distance D selected to limit the DOC of PDC cutting elements 204 without exhibiting any substantial formation material removal action.

As used herein, the term "mechanical specific energy" or "MSE" means and includes a value indicative of the work expended per unit volume of rock removed during a drilling operation. MSE may be calculated using weight-on-bit and torque-on-bit measurements made by bit-based sensors or made by sensors outside the drill bit. MSE may be computed as follows from bit-based sensors:

$$MSE=(k_1\times TOB\times RPM)/ROP\times D^2)+(k_2\times WOB/\pi\times D^2)$$

where, $k_1$ and $k_2$ are constants, TOB is the torque-on-bit, ROP is the obtained rate of penetration of the drill bit, D is the drill bit diameter and WOB is weight-on-bit determined using bit-based sensor measurement. MSE computed from WOB and TOB sensors outside the bit tends to reach higher values.

As used herein the term "Mu" indicates aggressiveness of a cutting element of a bit and this of the bit itself, and means and includes a ratio of TOB to WOB at a specific DOC as measured in inches per bit revolution.

Embodiments of the present disclosure comprise earth-boring tools employing aggressiveness control structures in the form of inefficient cutting elements in combination with conventional superabrasive cutting elements to engage and shear formation material, providing a drag force that increases with increased depth of cut of the superabrasive cutting elements to limit reactive torque at relatively higher WOBs. Such aggressiveness control structures may be contrasted to conventional DOCC features as exemplified by, for example, ovoid or other blunt bearing elements which engage a formation in a non-cutting, rubbing action and provide sufficient surface area to prevent the earth-boring tool from exceeding a compressive strength of a formation being drilled. While the latter may, as noted above, provide adequate aggressiveness control during constant WOB or gradual WOB changes, such bearing elements are substantially non-responsive in preventing stick-slip upon suddenly encountering a relatively softer formation at relatively higher WOB, or preventing impact damage to superabrasive cutting elements when suddenly moving from a softer to a relatively harder formation.

Figure 1B:
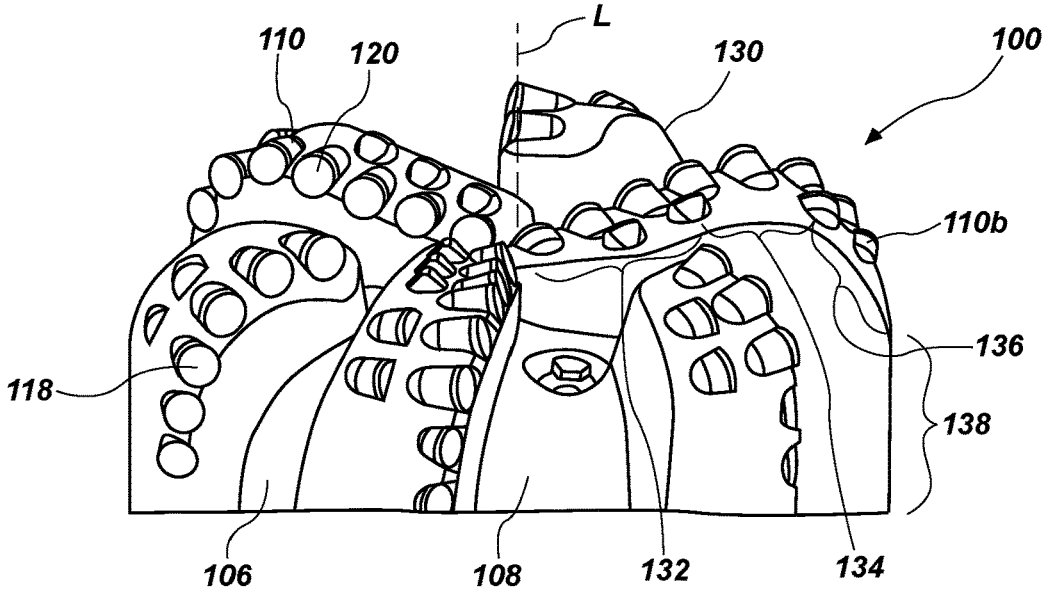

FIGS. 1A and 1B depict an embodiment of an earth-boring tool in the form of drag bit 100. Drag bit 100 is devoid of conventional DOCC bearing elements. Drag bit 100 comprises body 102 which includes generally radially extending blades 104 which protrude longitudinally. Body 102 is secured at the end thereof opposite blades to a structure (not shown) for securing drag bit 100 to a drill string or to a bottom-hole assembly (BHA), as is conventional. The structure for securing may, for example, comprise a shank having an API pin connection. Fluid passages 106 are located between blades 104 and extend to junk slots 108 along and radially inset from the outer diameter of the blades 104. Primary blades 104*p* extend generally radially outwardly from a longitudinal axis L of body 102 to an outer diameter of drag bit 100, while secondary blades 104*s* have radially inner ends remote from the longitudinal axis L and extend generally radially outwardly to the outer diameter of drag bit 100.

All blades 104 include superabrasive cutting elements, for example, cutting elements 110 comprising polycrystalline diamond tables 112 mounted to cemented carbide substrates 114 secured in pockets 116 and having two-dimensional cutting faces 118 facing in a direction of intended bit rotation during use. Cutting elements 110 are back raked, as known to those of ordinary skill in the art. As shown, diamond tables 112 have circular cutting faces 118 and arcuate cutting edges 120. However it should be appreciated that cutting elements 110 may comprise, for example, convex, concave or other three-dimensional cutting faces. In addition, cutting elements presenting other three-dimensional cutting surfaces may be employed as cutting elements 110. By way of non-limiting example, cutting elements as disclosed and claimed in U.S. Pat. Nos. 5,697,462; 5,706,906; 6,053,263; 6,098,730; 6,571,891; 8,087,478; 8,505,634; 8,684,112; 8,794,356 and 9,371,699, assigned to the Assignee of the present application and hereby incorporated herein in the entirety of each by this reference, may be employed as cutting elements 110. Further, cutting elements exhibiting different structures may be employed in combination as cutting elements 110 in implementation of embodiments of the present disclosure. Nozzles 122 in ports 124 in the fluid passages 106 direct drilling fluid out of the interior of drag bit 100 to cool cutting elements 110 and clear formation cuttings from cutting faces 118 and fluid passages 106 and through junk slots 108 up through an annulus between drag bit 100 and a wall of the wellbore being drilled. The face 130 of drag bit 100 includes a profile defined by blades 104 and specifically, the cutting edges 120 of cutting elements 110 mounted thereon, the profile comprising a cone region 132 extending radially from the longitudinal axis L, a nose region 134 radially outward from and surrounding cone region 132, a shoulder region 136 radially outward from and surrounding nose region 134, and a gage region 138 radially outward from and surrounding shoulder region 136. Optional, back raked backup cutting elements 110*b*, structured similarly to cutting elements 110, rotationally trail cutting elements 110 in the shoulder region 136.

Aggressiveness Control (AC) cutting elements 150 are located in cone region 132 of face 130 rotationally leading cutting elements 110 in the cone region 132. As depicted, AC cutting elements 150*a* may lie at similar radial positions as the cutting elements 110 which they respectively lead, AC cutting elements 150*b* may be partially radially offset from an associated cutting element 110 which they respectively lead, or as in the case of AC cutting elements 150*c*, may lie substantially radially between two respectively led cutting elements 110 to encounter and break formation rock tips between the cutting elements 110 on the profile. In some instances, AC cutting elements 150*c* may be laterally adjacent and between cutting elements 110. With various radial placements, AC cutting elements may in some instances rotationally trail cutting elements 110 mounted to a rotationally leading blade 104.

In generic terms, AC cutting elements 150 are purposefully structured to exhibit an inefficient cutting action, so as to require a substantial WOB increase when drag bit 100 takes a relatively deep DOC, while decreasing TOB relative to a bit without DOCC. AC cutting elements 150 are structured with a two-dimensional cutting face and exhibit a wide cutting edge trailed by an outer surface of measurable depth. As shown, the two-dimensional cutting face may be back raked more than a back rake of a cutting face of an associated cutting element 110; however, the cutting face back rake may be the same as or less than the back rake of an associated cutting element 110. Optionally, a trailing face may be oriented at a similar or different forward rake angle corresponding to the back rake angle of the cutting face.

As applications may be dependent on anticipated formation materials to be encountered as well as on cutting element size, AC cutting elements 150 may in some embodiments be exposed at a substantially similar exposure above the blade surface as cutting elements 110, and in some embodiments slightly less, for example, about 0.010 inch to about 0.040 inch, or about 0.020 less. In other embodiments, underexposure of AC cutting elements 150 may be significantly greater, or the order of about 0.100 to about 0.150 inch. An ultimate limit would be based upon size of the cutting element 110 and its exposure above the axially leading face of the blade. As a non-limiting example, in the case of a cutting element 110 with a one inch diameter cutting face half exposed above the blade, underexposure of an AC cutting element 150 might be as much as around 0.200 inch. In applications where a greater aggressiveness change is desired, AC cutting elements 150 may even be overexposed relative to cutting elements 110.

Figure 2A:
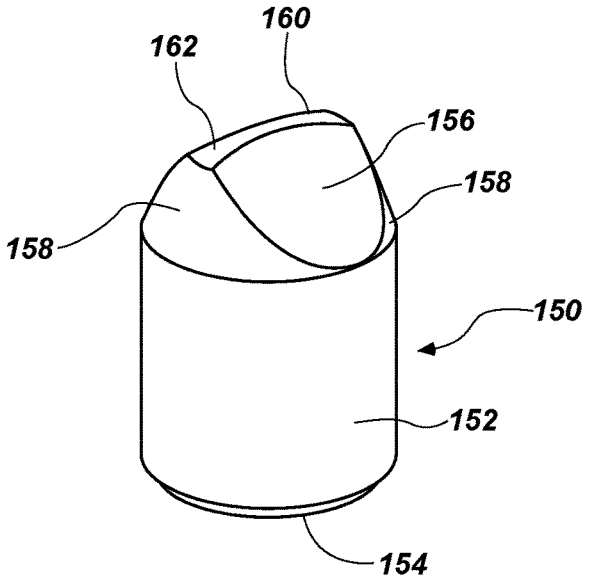
FIGS. 2A and 2B are, respectively, a perspective view and a frontal elevation (as to be mounted to an earth-boring tool) of an inefficient cutting element as employed on the drag bits of FIGS. 1A, 1B and 5 and as may be employed on other earth-boring tools.
Figure 2B:
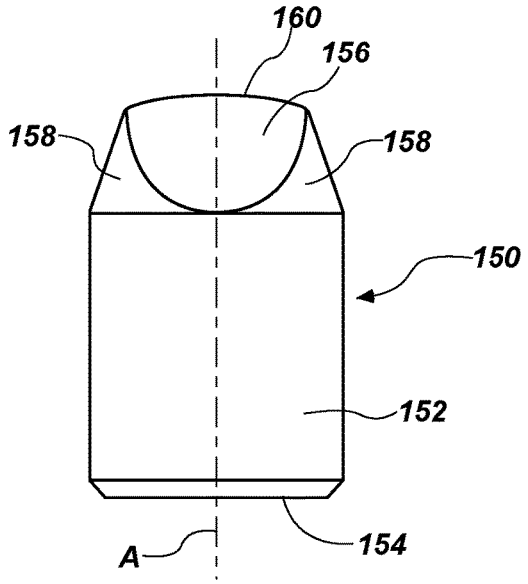

FIGS. 2A and 2B depict one example of an AC cutting element 150, as disclosed in U.S. Pat. No. 9,316,058, assigned to the Assignee of the present invention and the disclosure of which is incorporated herein in its entirety by this reference. AC cutting element 150 comprises a substrate 152 including a cylindrical portion, the end 154 of which (which may include a peripheral bevel) is received in a bore in a face of a primary blade 104*p* (see FIGS. 1A and 1B). Cutting face 156 is flanked at either side by arcuate, semi-frustoconical side surfaces 158 and extends from the cylindrical portion of substrate 152 to arcuate cutting edge 160, behind which lies apex surface 162. To the rear of apex surface 162, optional trailing face (not shown) may be a mirror image of cutting face 156 and lie at a same, similar or different angle to the axis A of AC cutting element 150, cutting face 156 and trailing face converging toward apex surface 162. Cutting face 156, cutting edge 160, apex surface 162 and the trailing face, as well as semi-frustoconical side surfaces 158 may comprise the same material as substrate 152 such as a cemented carbide (e.g., WC) and be integral therewith, or may comprise a superabrasive layer over material of the substrate, as disclosed in the aforementioned '058 patent. The superabrasive layer may comprise, for example, polycrystalline diamond, a cubic boron nitride compact, a chemical vapor deposition (CVD) applied diamond film, or diamond-like carbon (DLC).

FIGS. 6A through 6D depict another example of an AC cutting element 150'. Reference numerals indicating like features to those of AC cutting element 150 are identical for the sake of convenience. AC cutting element 150' comprises a substrate 152 including a cylindrical portion, the end 154 of which (which may include a peripheral bevel) is received in a bore in a face of a primary blade 104*p* (see FIGS. 1A and 1B). Cutting face 156 is flanked at either side by arcuate, semi-frustoconical side surfaces 158 and extends from the cylindrical portion of substrate 152 to arcuate cutting edge 160, behind which lies apex surface 162. To the rear of apex surface 162, trailing face 164 may be configured as a substantially convex protrusion 166 adjacent apex surface 162 leading downwardly and outwardly to a semi-frustoconical skirt portion 168 contiguous with side surfaces 158, rather than as a mirror image of cutting face 156 of AC cutting element 150'. The configuration of trailing face 164 may provide increased strength and durability to AC cutting element 150' against axial forces imposed by application of WOB as well as impact forces when transitioning between subterranean formation materials of significantly different hardness, and rotational forces. Cutting face 156, cutting edge 160, apex surface 162 and the trailing face 164, as well as semi-frustoconical side surfaces 158 may comprise the same material as substrate 152 such as a cemented carbide (e.g., WC) and be integral therewith, or may comprise a superabrasive layer over material of the substrate, as disclosed in the aforementioned '058 patent. The superabrasive layer may comprise, for example, polycrystalline diamond, a cubic boron nitride compact, a chemical vapor deposition (CVD) applied diamond film, or diamond-like carbon (DLC).

Another example of a suitable AC cutting element is disclosed in U.S. Pat. No. 6,098,730, also assigned to the Assignee of the present invention and the disclosure of which is incorporated herein in its entirety by this reference. Additional cutting element configurations suitable for use as AC cutting elements when oriented to provide a shearing cutting action when engaging a subterranean formation are disclosed by way of non-limiting example in U.S. Pat. Nos. 5,323,865; 5,551,768; 5,746,280; 5,855,247; 6,332,503; 8,061,456; 8,240,403; 9,074,435; and U.S. Patent Publication 2009/0159341, each of the foregoing assigned to the Assignee of the present invention and the disclosure of which is incorporated herein in its entirety by this reference.

It should be noted that the AC cutting elements 150', are mounted, according to embodiments of the disclosure to an earth-boring tool such as drag bit 100, rotated transversely, that is to say about 90°, to the orientation thereof when employed as disclosed in the '058 patent. Stated another way, in the '058 patent, the cutting element employs a frustoconical side surface 158 as a cutting face and its intersection with apex surface 162 as a cutting edge, and the cutting element is preferably back raked with respect to a direction of bit rotation for greatest durability and cutting efficiency in the disclosed drilling applications. It is also contemplated that the AC cutting elements 150', may be employed in implementation of embodiments of the disclosure with cutting face 156 oriented transverse to the direction of bit rotation, but also at a lesser included acute angle with respect thereto, for example and without limitation, between about 35° and about 55°, but not excluding other angles between zero to 89°.

While not wishing to be bound by any particular theory, it is believed that contact of cutting edges 160 and apex surfaces 162 of AC cutting elements 150', with a rock formation being drilled by cutting elements 110 at substantially the same time as cutting edges 120 of cutting elements 110 provides a robust but substantially inefficient cutting action, which is increased in inefficiency in the form of drag as more surface area of cutting faces 156 engages the rock as DOC increases, requiring greater WOB for a given DOC and reducing TOB at a given DOC for drag bit 100 relative to a bit without DOCC structures. By way of further explanation, embodiments of the present disclosure enable initiation of a target DOC, and/or create a desired Mu change at a selected DOC to obtain the desired effect of requiring greater WOB concurrently with reducing TOB relative to the same bit without DOCC structures. This phenomenon is particularly noticeable at relatively greater DOC, wherein formation cuttings from engagement of AC cutting elements 150', become trapped between cutting edges and faces of the cutting elements and the borehole end face. Stated another way, a number of AC cutting elements may be selected for placement on a rotary drag bit in consideration of bit size and anticipated subterranean formation material to be drilled to provide a predictable inflection point at a substantial DOC where required WOB increases significantly while TOB is controlled and a desired Mu change is initiated and MSE is not increased significantly.

Thus, it is apparent that earth-boring tools according to embodiments of the disclosure exhibit substantial resistance to stick-slip at relatively high WOB, enhanced tool face control, and provide an early indication in advance of the point where the bit may become catastrophically damaged, such as a ring out condition, where all cutting elements at a given radius on the bit face are severely damaged or broken off the bit face.

Example

Figure 4:
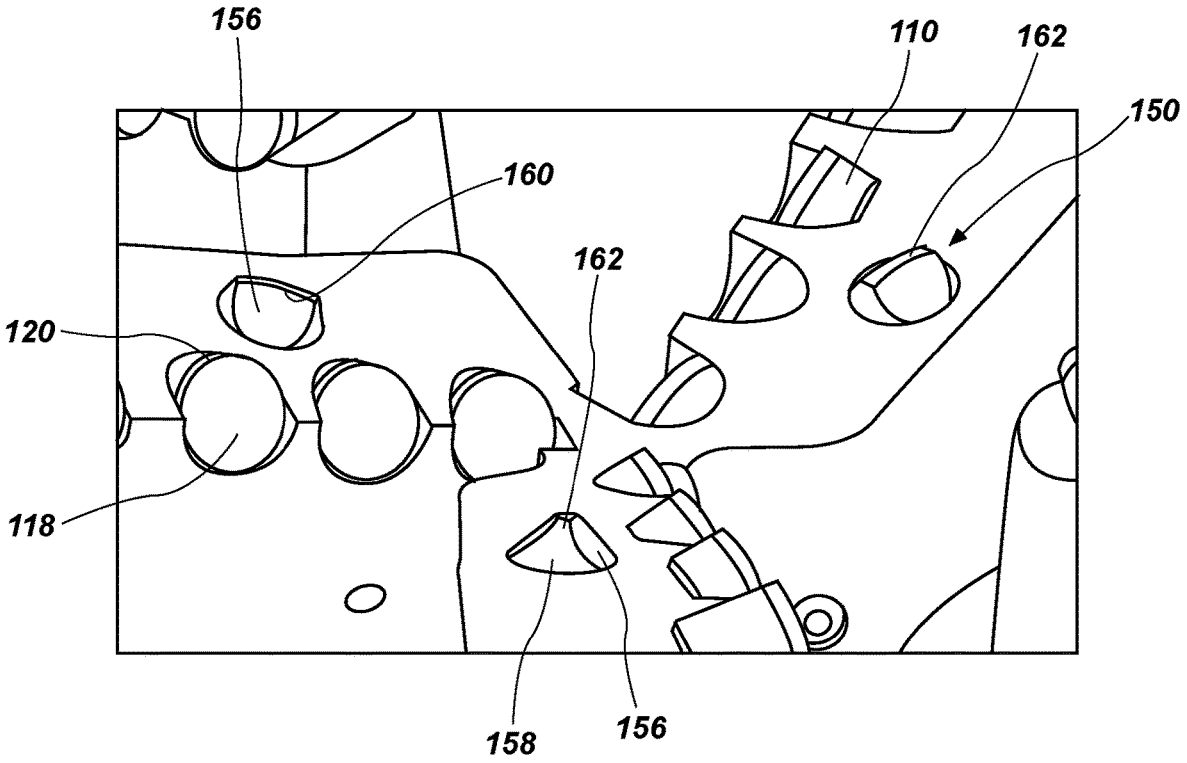
FIG. 4 is an enlarged perspective view of a drag bit equipped with three (3) inefficient cutting elements, as described in the EXAMPLE.

In laboratory tests, an 8.5 inch Baker Hughes T405 drag bit was run in an ROP control simulator laboratory test in Mancos shale at 3000 psi pressure and rotated at 90 rpm. WOB was increased from a baseline of about 5,000 lb. to about 50,000 lb. and DOC increased from a baseline of zero to over 0.20 in/rev. In four (4) different tests, the bit was respectively 1) run with no DOCC structures, 2) run with three ovoid DOCC structures in the cone region, underexposed 0.020 inch with respect to first, leading PDC cutting element exposure, 3) run with three AC cutting elements in the form of Baker Hughes STAYTRUE® PDC cutting elements as disclosed and claimed in U.S. Pat. No. 9,316,058, with apices and flanking planar faces oriented parallel to the direction of bit rotation in a conventional orientation for such cutting elements, underexposed 0.020 inch with respect to first, leading PDC cutting element exposure and 4) as shown in FIG. 4, run with three Baker Hughes STAYTRUE® cutting elements 150 with apices and a planar face oriented transverse to the direction of bit rotation in a "plow" orientation, underexposed 0.020 inch with respect to first, leading PDC cutting element 110 exposure. As is shown in the table below, under relatively high WOB, at about 35,000 lb and higher, with the bit taking a 0.16 in/rev depth of cut, the bit with the STAYTRUE® cutting elements in the plow orientation required 35% more WOB than the bit with no DOCC structures, while reducing TOB by 10%, MU by 15% and increasing MSE by only 15%. This slight increase in MSE is negligible compared to reduction or elimination of the potential for highly damaging stick-slip. Perhaps even more significantly when the bit was equipped with ovoid DOCC structures, WOB at 0.16 in/rev depth of cut was only 20% greater than the bit with no DOCC structures, with no TOB decrease, only a 5% decrease in MU, and a 10% increase in MSE. Thus, the bit when equipped with plow-oriented Stay True cutting elements required seventy-five percent (75%) more WOB to achieve the same DOC. It is anticipated that the favorable response change exhibited by the test bit when equipped with only three AC cutting elements will be of greater magnitude where more such AC cutting elements, for example eight AC cutting elements as depicted in FIGS. 1A and 1B or nine AC cutting elements as depicted in FIG. 5, which be typical and representative of the number of conventional DOCC structures used on similarly sized bits, are placed in the cone region.

| 0.16 in/rev DOC | WOB | TOB | MU | MSE |
|---|---|---|---|---|
| STAYTRUE ® Conventional | +10% | ~ | ~ | +10% |
| Ovoids | +20% | ~ | −5% | +10% |
| STAYTRUE ® Transverse | +35% | −10% | −15% | +15% |

Figure 5:
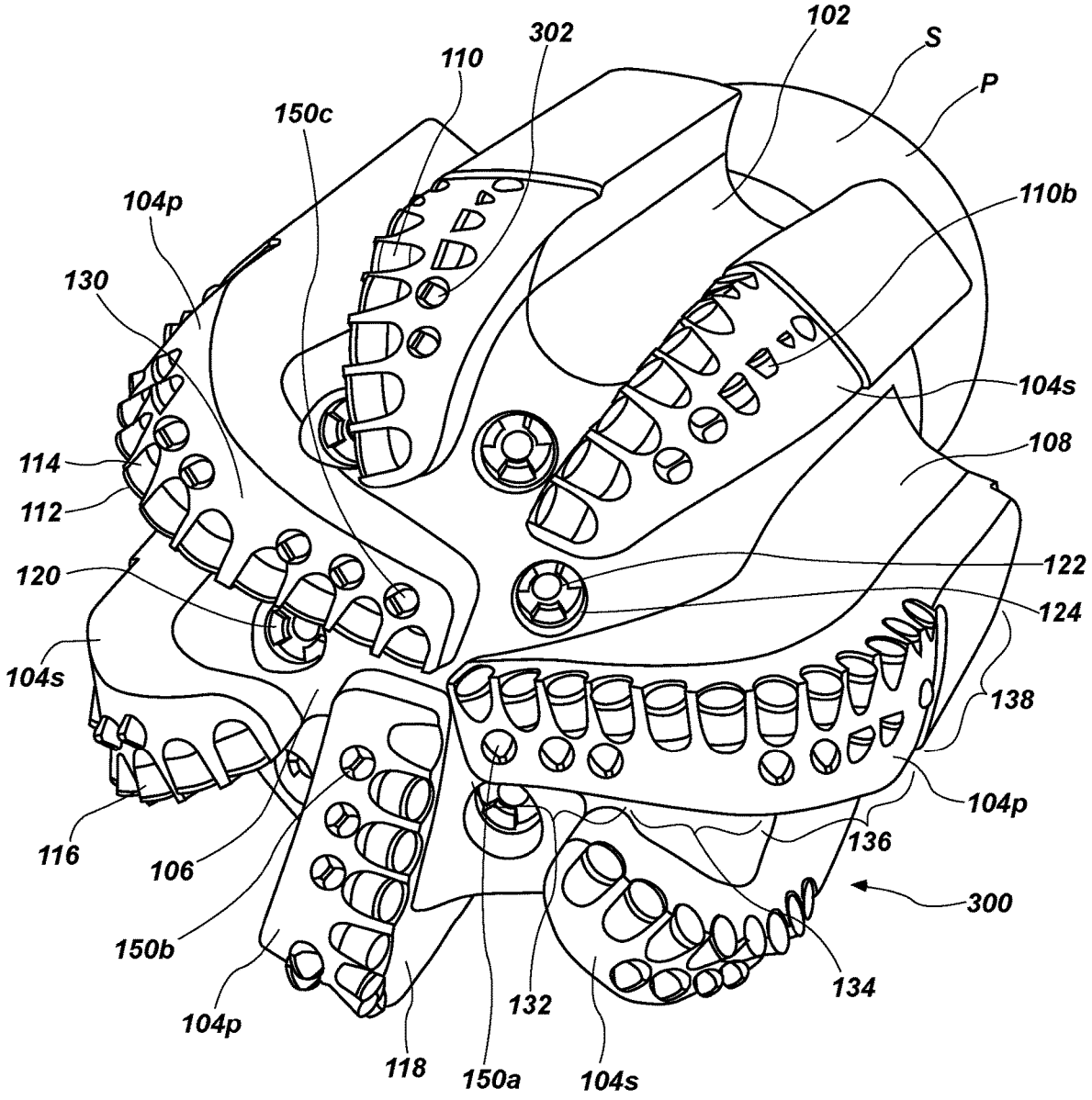
FIG. 5 is a perspective frontal view of another earth-boring tool in the form of a drag bit according to another embodiment of the disclosure.
Figure 6A:
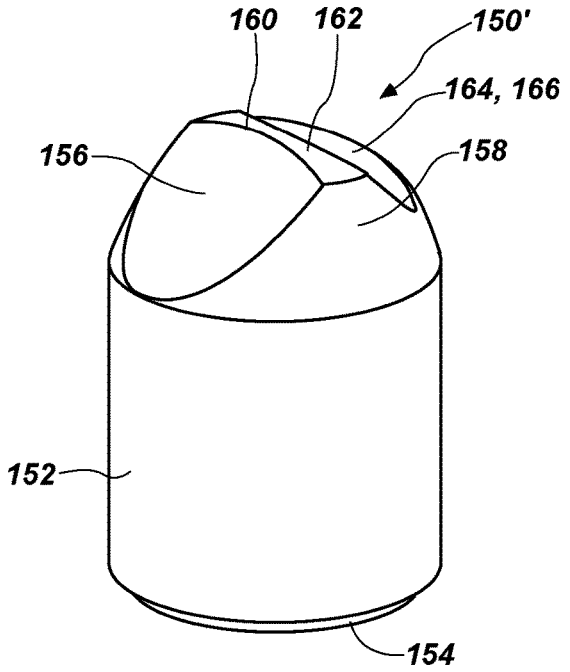
FIGS. 6A through 6D are, respectively, a frontal perspective view, a rear perspective view, a side elevation and a top elevation of an inefficient cutting element as may be employed on the drag bits of FIGS. 1A, 1B and 5 or other earth-boring tools.
Figure 6B:
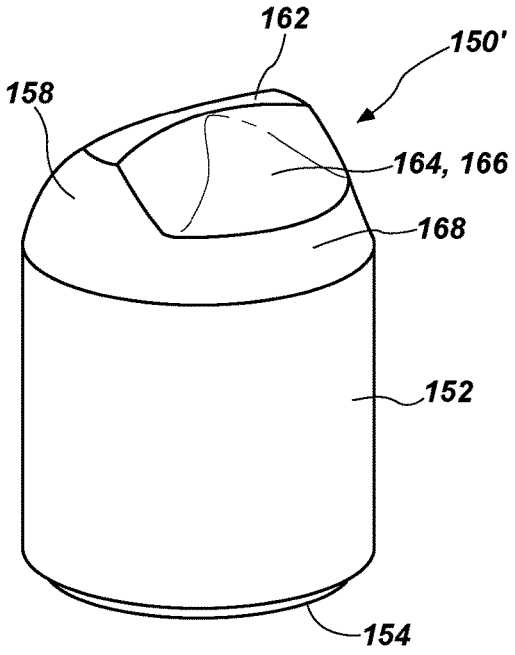
Figure 6C:
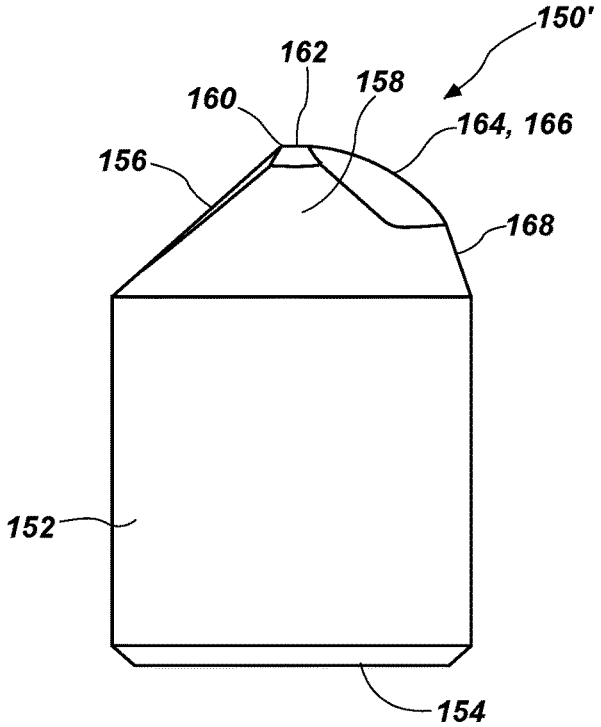
Figure 6D:
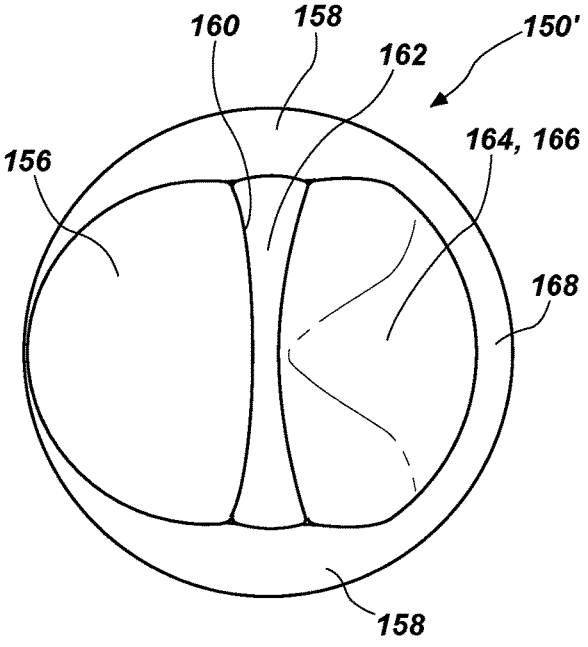

FIG. 5 is a perspective frontal view of another embodiment of an earth-boring tool in the form of drag bit 300, wherein elements common to FIGS. 1A and 1B and FIG. 5, respectively, are identified by the same reference numerals. As is the case with drag bit 100, drag bit 300 is devoid of conventional DOCC bearing elements. Drag bit 300 comprises body 102 which includes generally radially extending blades 104 which protrude longitudinally. Body 102 is secured at the end thereof opposite blades to structure S for securing drag bit 300 to a drill string or to a bottom hole assembly (BHA), as is conventional. The structure for securing may, for example, comprise a shank having an API pin connection P. Fluid passages 106 are located between blades 104 and extend to junk slots 108 along and radially inset from the outer diameter of the blades 104. Primary blades 104*p* extend generally radially outwardly from a longitudinal axis L of body 102 to an outer diameter of drag bit 300, while secondary blades 104*s* have radially inner ends remote from the longitudinal axis L and extend generally radially outwardly to the outer diameter of drag bit 300.

All blades 104 include superabrasive cutting elements, for example, cutting elements 110 comprising polycrystalline diamond tables 112 mounted to cemented carbide substrates 114 secured in pockets 116 and having two-dimensional cutting faces 118 facing in a direction of intended bit rotation during use. Cutting elements 110 are back raked, as known to those of ordinary skill in the art. As shown, diamond tables 112 have circular cutting faces 118 and arcuate cutting edges 120. Nozzles 122 in ports 124 in the fluid passages 106 direct drilling fluid out of the interior of drag bit 300 to cool cutting elements 110 and clear formation cuttings from cutting faces 118 and fluid passages 106 and through junk slots 108 up through an annulus between drag bit 300 and a wall of the wellbore being drilled. The face 130 of drag bit 300 includes a profile defined by blades 104 and specifically, the cutting edges 120 of cutting elements 110 mounted thereon, the profile comprising a cone region 132 extending radially from the longitudinal axis L, a nose region 134 radially outward from and surrounding cone region 132, a shoulder region 136 radially outward from and surrounding nose region 134, and a gage region 138 radially outward from and surrounding should region 136. Optional, back raked backup cutting elements 110*b*, structured similarly to cutting elements 110, rotationally trail cutting elements 110 in the shoulder region 136.

Aggressiveness Control (AC) cutting elements 150 are located in cone region 132 of face 130 rotationally trailing cutting elements 110 in the cone region 132. As depicted, AC cutting elements 150*a* may lie at similar radial positions as the cutting elements 110 which they respectively trail, AC cutting elements 150*b* may be partially radially offset from an associated cutting element 110 which they respectively trail, or as in the case of AC cutting elements 150*c*, may lie substantially radially between two respectively trailed cutting elements 110. With various radial placements, AC cutting elements may in some instances rotationally lead cutting elements 110 mounted to a rotationally following blade 104.

As with drag bit 100, drag bit 300 also employs Baker Hughes STAYTRUE® cutting elements 302 as disclosed and claimed in U.S. Pat. No. 9,316,058, with apices and flanking planar faces oriented parallel to the direction of bit rotation in a conventional orientation for such cutting elements, on the nose region 134 thereof.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being encompassed within the scope of the disclosure.

What is claimed is:

1. An earth-boring tool, comprising:

a body;

first cutting elements mounted to an axially leading face of the body, the first cutting elements each having a cutting face exposed to a height above the face of the body, the cutting faces of the first cutting elements back raked and facing a direction of intended rotation of the earth-boring tool; and second cutting elements mounted to the axially leading face of the body adjacent first cutting elements in a cone region of the axially leading face adjacent a longitudinal axis of the body, the second cutting elements each having a single, two-dimensional cutting face with a cutting edge trailed by an outer surface of measurable depth and configured for a shear-type cutting action exposed to a height above the face of the body, the two-dimensional cutting faces of the second cutting elements back raked to about a same or greater extent than the cutting faces of the first cutting elements and generally facing the direction of intended rotation of the earth-boring tool.

2. The earth-boring tool of claim 1, wherein the body comprises longitudinally and generally radially extending blades, and the first cutting elements and the second cutting elements are mounted to the blades.

3. The earth-boring tool of claim 2, wherein the second cutting elements rotationally trail respective adjacent first cutting elements on a same blade.

4. The earth-boring tool of claim 2, wherein the second cutting elements rotationally lead respective adjacent first cutting elements on a different blade.

5. The earth-boring tool of claim 2, wherein at least some of the second cutting elements are located to at least partially overlap a cutting path of a respective adjacent first cutting element.

6. The earth-boring tool of claim 2, wherein at least some of the second cutting elements are located substantially between cutting paths of two radially adjacent first cutting elements.

7. The earth-boring tool of claim 2, wherein the first cutting elements and the second cutting elements comprise superabrasive cutting elements.

8. The earth-boring tool of claim 2, wherein the blades define a profile of the body, the profile comprising the cone region, a nose region radially outward of and surrounding the cone region, a shoulder region radially outward of and surrounding the nose region, and a gage region radially outward of and surrounding the shoulder region.

9. The earth-boring tool of claim 8, wherein the second cutting elements are located only in the cone region.

10. The earth-boring tool of claim 9, wherein the second cutting elements are superabrasive cutting elements rotationally leading, trailing or between respective adjacent first superabrasive cutting elements.

11. The earth-boring tool of claim 10, wherein the first superabrasive cutting elements exhibit an arcuate cutting edge, and the second superabrasive cutting elements exhibit a cutting edge of greater radius than a radius of the cutting edge of the first superabrasive cutting elements.

12. The earth-boring tool of claim 11, wherein the cutting edges of the second superabrasive cutting elements are trailed by apex surfaces of measurable depth.

13. The earth-boring tool of claim 9, wherein the cone region is devoid of bearing elements.

14. The earth-boring tool of claim 1, wherein the height of exposure of the first cutting elements in the cone region and the height of exposure of the second cutting elements are substantially the same.

15. The earth-boring tool of claim 1, wherein the height of exposure of the second cutting elements is less than the height of exposure of the first cutting elements in the cone region.

16. The earth-boring tool of claim 1, wherein the height of exposure of the second cutting elements is greater than the height of exposure of the first cutting elements in the cone region.

17. An earth-boring tool, comprising:

a body having generally radially extending blades protruding longitudinally therefrom;

first superabrasive cutting elements mounted to axially leading blade faces adjacent rotationally leading faces thereof, the first superabrasive cutting elements each comprising a cutting face configured for a shear-type cutting action, oriented substantially in a direction of intended bit rotation and exhibiting an aggressiveness;

second superabrasive cutting elements mounted to axially leading blade faces in a cone region thereof, the second superabrasive cutting elements each comprising a single, two-dimensional cutting face configured for a shear-type cutting action, the single, two-dimensional cutting face oriented substantially in the direction of intended bit rotation and exhibiting a lesser aggressiveness than the aggressiveness of the first superabrasive cutting elements; and the adjacent second superabrasive cutting elements exhibiting substantially the same or less exposure above the axially leading face of the common blade as the first superabrasive cutting elements.

18. The earth-boring tool of claim 17, wherein the second superabrasive cutting elements are located only in the cone region of the blade faces of the earth-boring tool.

19. The earth-boring tool of claim 17, wherein cutting faces of the second superabrasive cutting elements exhibit a back rake about a same as or greater than cutting faces of the adjacent first superabrasive cutting elements.

20. The earth-boring tool of claim 17, wherein a radius of curvature of cutting edges of cutting faces of the second superabrasive cutting elements is greater than a radius of curvature of cutting faces of the adjacent first superabrasive cutting elements.

21. A method of drilling a subterranean formation, the method comprising:

engaging a subterranean formation to shear formation material with a first set of fixed cutting elements of a rotary drag bit under applied WOB and TOB; and engaging the subterranean formation under the applied WOB and TOB to shear formation material less efficiently with a second set of fixed cutting elements each comprising a single, two-dimensional cutting face oriented substantially in the direction of intended bit rotation in a cone region of the rotary drag bit, the single, two-dimensional cutting face backraked to reduce an aggressiveness of the rotary drag bit.

* * * * *